US005770555A

United States Patent [19]

Weinstein

[11] Patent Number: 5,770,555

[45] Date of Patent: Jun. 23, 1998

[54] HIGH ALKALI-CONTAINING CLEANING CONCENTRATES

[75] Inventor: Barry Weinstein, Dresher, Pa.

[73] Assignee: Rohm and Haas Company, Philadelphia, Pa.

[21] Appl. No.: 748,260

[22] Filed: Nov. 13, 1996

[51] Int. Cl.[6] ..... C11D 3/37

[52] U.S. Cl. ..... 510/434; 510/218; 510/234; 510/370; 510/476

[58] Field of Search ..... 510/218, 234, 510/434, 370, 476

[56] References Cited

U.S. PATENT DOCUMENTS

| | | | |
|---|---|---|---|
| 5,273,675 | 12/1993 | Lein et al. | 252/103 |
| 5,336,815 | 8/1994 | Becker et al. | 568/857 |
| 5,520,841 | 5/1996 | Block et al. | 510/454 |
| 5,534,183 | 7/1996 | Gopalkrishnal et al. | 510/454 |
| 5,534,184 | 7/1996 | Underwood | 510/454 |
| 5,536,440 | 7/1996 | Gopalkrishnan et al. | 510/454 |
| 5,618,782 | 4/1997 | Gopalkrshnan et al. | 510/476 |

FOREIGN PATENT DOCUMENTS

| | | |
|---|---|---|
| 05 214397 | 2/1992 | Japan . |

*Primary Examiner*—Jacqueline V. Howard
*Attorney, Agent, or Firm*—Thomas J. Howell

[57] ABSTRACT

A process for preparing stable aqueous cleaning concentrate compositions containing high concentrations of alkali and polymers useful as scale-inhibiting cleaning additives is disclosed. Water-soluble polymer additives useful for preparing the stable cleaning concentrates are polymers of acrylic acid, and optionally maleic acid, and selected allyloxy monomers. The storage-stable cleaning concentrates are especially useful in providing cleaning formulations for automatic washing systems, such as bottle washing and clean-in-place operations.

18 Claims, No Drawings

HIGH ALKALI-CONTAINING CLEANING CONCENTRATES

This is a nonprovisional application of prior pending provisional application Ser. No. 60/006,975, filed Nov. 20, 1995.

BACKGROUND

This invention relates to an improved method for preparing stable alkali-soluble cleaning compositions. More particularly the invention relates to the selection of polymer additives for use in cleaning compositions that provide storage-stable, homogeneous cleaning concentrates that are useful in the cleaning of food soils from hard surfaces, such as encountered in bottle washing and clean-in-place (circulation cleaning) operations.

Present day automation has influenced hotel and restaurant operations to a point where most eating utensils are cleaned by automatic washing procedures. The detergents used in these applications must have adequate cleaning properties and be provided in a physical form that is easily handled and able to be added to the cleaning operation in well defined amounts. Powder cleaning compositions are primarily made up of alkaline inorganic salts, such as phosphates, silicates and carbonates (known as "builders"). These powder detergents have the disadvantage of requiring dissolution with water in order to be added to the automatic washing operation in a controlled manner and in many cases non-uniform addition of the detergent occurs because the more readily dissolved cleaning components are delivered to the washing operation first. Liquid cleaning formulations have been developed to address the disadvantages of powder formulations but liquid formulations are also limited in their cleaning efficiency due to the large amounts of water required to dissolve the cleaning components; in addition, incompatibility of some cleaning components further limits preparation of a wide range of cleaning formulations in liquid form. Also, hardness ions (such as calcium, magnesium or barium) naturally present in the rinse water or water used for preparing the concentrate or cleaning solutions can further aggravate the cleaning problem because of their tendency to react with the cleaning solution and inactivate builder components in the cleaning solution. In order to counteract the effect of hardness ions, cleaning compositions contain builders and scale-inhibitor components (such as phosphonates) to prevent and minimize the buildup of hardness deposits (such as insoluble phosphate, carbonate and sulfate salts) or "scale" on surfaces.

Equipment used to manufacture, store or transport foodstuffs can be soiled by a variety of mechanisms, such as residues from degradation during cooking operations and residues from other food preparation and processing operations. Clean-in-place (CIP) operations are used to clean a major portion of the equipment in modern dairy plants and other food processing operations as well. CIP operations use a combination of chemical and physical effects to remove soil from surfaces by transporting the cleaning solution to the soiled surface, and combining the factors of time, temperature, detergency and force. CIP operations are typically used in pipe-line systems, tanks and vats, heat exchangers, homogenizers and centrifugal machines.

Phosphorus-containing compounds (such as phosphates and phosphonates) have been used as builders and scale-inhibitors of choice in previous aqueous cleaning solutions, but because of the increased use of liquid detergents, where sodium tripolyphosphate has a limited solubility, and increased environmental concerns on the use of phosphorous containing builders, alternative compositions have been investigated. However, with the decrease in phosphate use, cleaning performance of the cleaning compositions has also decreased.

JP 05-214397 discloses the use of 1 to 50% by weight carboxylated poly(ethyleneglycol)s as builders in solid cleaning formulations containing up to 60% by weight alkali metal hydroxide for automatic dishwashers. U.S. Pat. No. 5,273,675 discloses copolymers of acrylic acid and maleic anhydride, optionally containing a carboxyl-free unsaturated monomer, useful in cleaning concentrates containing an active-chlorine source.

Despite the large number of liquid cleaning compositions available as hard surface cleaners, there is a still a need for liquid cleaning compositions that can be prepared in highly concentrated form in the presence of high alkali metal hydroxide concentrations, that are stable upon storage and that provide satisfactory cleaning and scale-inhibition during bottle washing, the cleaning of soiled food processing equipment or the cleaning of eating and drinking utensils.

The present invention seeks to overcome the problems of the prior art by providing an improved process for preparing stable alkali-soluble cleaning compositions having satisfactory cleaning and scale-inhibition properties.

STATEMENT OF INVENTION

A method for preparing a stable aqueous cleaning concentrate comprising combining in an aqueous solution (a) from 1 to 10 percent, based on total cleaning concentrate weight, of a water-soluble polymer comprising as polymerized units (i) from 20 to 80 percent, based on total polymer weight, of unsaturated monocarboxylic acid monomer selected from one or more of acrylic acid, methacrylic acid and water-soluble salts thereof; (ii) from 0 to 65 percent, based on total polymer weight, of unsaturated dicarboxylic acid monomer; and (iii) from 5 to 50 percent, based on total polymer weight, of unsaturated non-ionizable monomer selected from one or more monomers of Formula I:

$$CH_2{=}C(R^1)CH(R^2)OR^3 \quad (I)$$

where:

$R^1$ is selected from hydrogen, methyl and —$CH_2OH$;

$R^2$ is selected from hydrogen, methyl and —$CH_2OH$;

$R^3$ is selected from hydrogen, —$CH_2CH(CH_3)OH$, —$CH_2CH_2OH$ and ($C_3$–$C_{12}$)-containing polyol residues; and (b) from 15 to 50 percent, based on total cleaning concentrate weight, of an alkali metal hydroxide selected from one or more of sodium hydroxide and potassium hydroxide.

The present invention further provides an aqueous cleaning concentrate comprising from 1 to 10 percent, based on total cleaning concentrate weight, of a water-soluble polymer as described above, from 15 to 50 percent, based on total cleaning concentrate weight, of an alkali metal hydroxide selected from one or more of sodium hydroxide and potassium hydroxide, and water.

DETAILED DESCRIPTION

Water-soluble polymer additives useful in the present invention contain as polymerized units from 20 to 80 percent (%), preferably from 30 to 70% and more preferably from 40 to 60%, of monocarboxylic acid monomer selected from one or more of acrylic acid, methacrylic acid and water-soluble salts thereof; from 0 to 65%, preferably from 15 to 50% and more preferably from 20 to 40%, of dicarboxylic acid monomer; and from 5 to 50%, preferably from 10 to 30% and ore preferably from 10 to 20% of an unsaturated non-ionizable monomer selected from one or more monomers of Formula I; all percentages are by weight and are based on total weight of water-soluble polymer. Water-soluble salts of the polymer additives, for example, the alkali metal salts (such as sodium or potassium), and the ammonium or substituted ammonium salts thereof, can also be used.

In one embodiment of the invention, the water-soluble polymer comprises as polymerized units from 40 to 55% of unsaturated monocarboxylic acid monomer, from 30 to 50% of unsaturated dicarboxylic acid monomer and from 10 to 20% of unsaturated non-ionizable monomer. In another embodiment of the invention, the water-soluble polymer comprises as polymerized units from 60 to 80% of unsaturated monocarboxylic acid monomer, from 0 to 10% of unsaturated dicarboxylic acid monomer and from 20 to 40% of unsaturated non-ionizable monomer. Suitable unsaturated non-ionizable monomers include, for example, allyl alcohol, 3-allyloxy-1,2-propanediol, allyloxyethanol, allyloxypropanol, erythritol monoallyl ether, pentaerythritol monoallyl ether and 1-butene-3,4-diol. Preferred unsaturated non-ionizable monomers are allyl alcohol and 3-allyloxy- 1,2-propanediol.

"Unsaturated dicarboxylic acid monomer," as used herein, refers to monoethylenically unsaturated dicarboxylic acids containing 4 to 10, preferably from 4 to 6, carbon atoms per molecule and anhydrides of the cis-dicarboxylic acids. Dicarboxylic acid monomers useful in the water-soluble polymer additives of the present invention include, for example, maleic acid, maleic anhydride, a-methylene glutaric acid, fumaric acid, itaconic acid, citraconic acid, mesaconic acid, cyclohexenedicarboxylic acid, cis-1,2,3,6-tetrahydrophthalic anhydride (also known as cis-4-cylcohexene-1,2-dicarboxylic anhydride) and water-soluble salts thereof. Preferred unsaturated dicarboxylic acid monomers are maleic acid and maleic anhydride.

Monomers of Formula I may be prepared by a variety of synthetic routes known to those skilled the art. For example, allyl chloride may be reacted with various polyhydroxy compounds to give, for example, the corresponding allyloxy derivatives of sugars, glycerine, erythritol and pentaerythritol. Alternatively, allyl alcohol may be reacted with various halomethyl derivatives, especially chloromethyl compounds, to prepare allyloxy derivatives; for example, the reaction of allyl alcohol with epichlorohydrin would produce 3-allyloxy-1,2-propanediol. Vinyl glycols, such as 1-butene-3,4-diol, for example, may be prepared by methods such as those described in U.S. Pat. No. 5,336,815. Allyloxy compounds that would hydrolyze to allyloxy compounds of Formula I under the conditions of aqueous polymerization, for example allyl glycidylether, are also useful as monomers to produce polymer additives of the present invention.

The ($C_3$–$C_{12}$)-containing polyols useful to prepare allyloxy compounds of Formula I include, for example, ($C_3$–$C_6$)-polyhydroxy compounds such as erythritol, pentaerythritol and glycerine; and sugar alcohols such as xylitol, sorbitol and mannitol. Additional suitable ($C_3$–$C_{12}$)-containing polyols include, for example, polyhydroxy aldehyde and ketone sugars such as glucose, fructose, galactose, maltose, sucrose, lactose, erythrose and threose. Examples of suitable unsaturated non-ionizable monomers, including representative examples of monomers based on ($C_3$–$C_{12}$)-containing polyols (compounds [5], [6], [7], [8], [9] and [10]; see $R^3$ groups) are presented in Table I. The prefixes "($C_3$–$C_{12}$)-" and "($C_3$–$C_6$)-," as used herein, refer to organic compounds or structural portions of organic compounds containing 3 to 12 carbon atoms and 3 to 6 carbon atoms, respectively. The terms "polyol" and "polyhydroxy," as used herein, refer to organic compounds or structural portions of organic compounds containing two or more hydroxy groups.

TABLE I

| Unsaturated Non-Ionizable Monomer | $R^1$ | $R^2$ | $R^3$ |
|---|---|---|---|
| allyl alcohol [1] | —H | —H | —H |
| methallyl alcohol [2] | $-CH_3$ | —H | —H |
| allyloxy-ethanol [3] | —H | —H | $—CH_2CH_2OH$ |
| allyloxypro-panol [4] | —H | —H | $—CH_2CH(CH_3)OH$ |
| 3-allyloxy-1,2-propane-diol [5] | —H | —H | $—CH_2CH(OH)CH_2OH$ |
| allyloxy (sugar) [6] | —H | —H | -sugar residue |
| allyloxy (glucose) [7] | —H | —H | $—CH_2[CH(OH)]_4C(=O)H$ |
| allyloxy (fructose) [8] | —H | —H | $—CH_2[CH(OH)]_3C(=O)CH_2OH$ |
| erythritol monoallyl ether [9] | —H | —H | $—CH_2[CH(OH)]_2CH_2OH$ |
| pentaerythritol monoallyl ether [10] | —H | —H | $—CH_2C(CH_2OH)_3$ |
| 1-butene-3,4-diol [11] | —H | $—CH_2OH$ | —H |

The concentration of water-soluble polymer additives (active ingredient) in cleaning concentrate compositions of the present invention is from 1 to 10%, preferably from 1 to 5% and more preferably from 1 to 2%, by weight of the concentrate. The concentration of polymer additive in the concentrate composition is dependent on the amount of other components present that may have an impact on the desired performance and compatibility characteristics of the concentrate. For example, if a phosphate containing compound is present in the cleaning concentrate, the effective amount of polymer additive necessary to achieve the desired cleaning performance may be lower than if no phosphate containing compound is present. Substitution of the polymer additives of this invention for phosphorous containing compounds (commonly used in cleaning compositions containing phosphate builders) should be considered where the use of phosphates is restricted.

Cleaning concentrate compositions of this invention are in the form of a liquid. As used herein, "liquid" also refers to a gel or a slurry. The concentrate compositions may include additional conventional cleaning additives well known to those skilled in the art, in conventional use amounts. Optional conventional cleaning additives include, for example, builders, sequestrants, water-soluble surfactants, anti-foaming agents, corrosion inhibitors, bleaching agents, stabilizers, anti-spotting agents and opacifiers. The quantity of optional conventional additives used will generally be from 0 to 40% and preferably from 1 to 20% by weight of the liquid cleaning concentrate composition.

The cleaning concentrate compositions of this invention may contain builders, including, for example, inorganic builder salts such as alkali metal polyphosphates (such as tripolyphosphates and pyrophosphates); ethylenediaminetetraacetic acid, nitrilotriacetate and alkali metal carbonates;

water-soluble organic builders such as citrates, polycarboxylates and carboxylates; and monomeric (for example, aminotrismethylenephosphonic acid, 2-phosphonobutane-1,2,4-tricarboxylic acid (PBTC), hydroxyethanediphosphonic acid, diethylenetriamine-penta(methylenephosphonic acid), ethylenediamine-tetraethylenephosphonic acid and salts thereof), oligomeric and polymeric phosphonates. The amount of builder used will generally be from 0 to 10%, preferably from 2 to 5%, by weight of liquid cleaning concentrates.

The cleaning concentrate compositions of this invention may also contain an alkali metal silicate builder at a concentration of 0 to 10% and preferably 3 to 5% by weight of the concentrate. The more preferred alkali metal silicates are the sodium silicates. Although the alkali metal silicates are an optional component of the present invention, silicates are beneficial when corrosion inhibition of metal parts is desired since highly alkaline dishwashing compositions containing no silicates may attack aluminum pots and pans and other metal utensils.

Although optional, the cleaning concentrate compositions of this invention will generally contain a low-foaming wetting agent, usually in the form of a water-soluble surfactant, for example, non-ionic and amphoteric surfactants, at a concentration of 0 to 2% and preferably 0.5 to 1% by weight of the concentrate. Low-foaming wetting agents are preferred for the concentrate compositions since foam may reduce the mechanical efficiency of wash spray or rinsing cycles of certain types of cleaning operations. Low-foaming water-soluble anionic, non-ionic, zwitterionic, amphoteric surfactants or combinations thereof may be employed.

Optionally, the cleaning concentrate compositions of this invention may contain bleaching agents, for example, chlorine-generating substances (such as sodium hypochlorite or chloroisocyanurates), peroxides, sulfites and perborates. Preferably, the concentrate compositions do not contain chlorine-generating bleaching agents.

In addition, the cleaning concentrate compositions of this invention may contain sequestrants, such as sodium gluconate, at concentrations of 0 to 5% and preferably 1 to 2% by weight of the concentrate.

It has been found that the performance of the polymer additives used in the present invention is not dependent upon molecular weight, provided that the molecular weight of the polymer does not adversely affect its compatibility with other components of the cleaning compositions. Weight average molecular weights ($M_w$) of the polymer additives of the present invention are typically from 1,000 to 100,000, preferably from 2,000 to 40,000, more preferably from 3,000 to 15,000, and most preferably from 4,000 to 10,000, as measured by aqueous gel permeation chromatography (GPC).

Because of their solubility properties, the polymer additives are useful in cleaning solutions containing high levels of caustic. Many cleaning solutions, such as industrial bottle washing detergents, clean-in-place detergents, and industrial and institutional detergents, contain high levels of caustic. The polymer additives are useful in these detergent compositions as scale-inhibitors, dispersants, sequestrants and anti-precipitants; however, many prior art polymers, such poly (acrylic acid) and acrylic acid-maleic acid copolymers, cannot be used in these applications because they are not soluble in the highly caustic solutions.

In addition to providing the preparation of storage-stable cleaning concentrates, the water-soluble polymer additives are useful in cleaning solutions prepared by other methods. For example, cleaning solutions may be prepared by combining, as separate components, the water-soluble polymer additive, a 20 to 50 percent aqueous solution of the alkali metal hydroxide and water (sufficient for dilution), where the polymer, the alkali metal hydroxide solution and the water are added as separate streams into an in-line mixing system. Optionally, an aqueous solution of conventional cleaning additives may also be added as a separate stream or used in place of the dilution water component in preparing the cleaning solutions.

The resultant cleaning solutions obtained by either diluting the cleaning concentrate compositions of the present invention or by other methods, such as those described above, typically contain (a) 0.005 to 0.4%, preferably 0.01 to 0.1%, of the water-soluble polymer additive, (b) 0.1 to 3%, preferably 0.2 to 2% and more preferably 0.5 to 1.5%, of an alkali metal hydroxide, (c) water and, optionally, (d) 0.001 to 2% of conventional cleaning additives; all concentrations are based on total cleaning solution weight.

Use of the water-soluble polymer additives in cleaning solutions (diluted from concentrates or prepared by other methods) provides a method for cleaning hard surface materials comprising contacting a soiled hard surface material with an effective amount of cleaning solution containing the water-soluble polymer additive until substantial removal of soil is accomplished.

Aqueous solutions of cleaning compositions of the present invention are effective for cleaning soiled surfaces over a wide range of wash water temperatures, typically from 5° to 95° C., preferably from 30° to 80° C. and more preferably from 50° to 70° C.

Concentrations of alkali metal hydroxide (sodium hydroxide or potassium hydroxide) in cleaning concentrate compositions of the present invention range from 15 to 50%, preferably from 20 to 50% and more preferably from 25 to 40%, based on weight of the cleaning concentrate. A typical caustic cleaning concentrate composition contains 50 to 85% "caustic" or "soda lye" (as 50% aqueous sodium hydroxide), 1 to 2% "polymer additive" and 0 to 40% optional conventional cleaning additives, with the remainder being water.

Alkali metal hydroxide concentrations in the cleaning concentrate can vary depending upon the end-use application. For example, dishware cleaning concentrates typically contain 5 to 20% by weight alkali metal hydroxide, clean-in-place concentrates typically contain 10 to 30% by weight alkali metal hydroxide, and bottle washing cleaning concentrates typically contain greater than 35% by weight alkali metal hydroxide.

Liquid cleaning concentrate compositions of the present invention are typically prepared by dissolving the polymer additive and optional conventional cleaning additives in the desired amount of caustic (with cooling) to provide the homogeneous liquid cleaning concentrate. The cleaning concentrates are typically diluted with water to provide the actual cleaning solutions used to contact soiled hard surface materials. Cleaning solutions are formed by diluting the cleaning concentrates to 0.1 to 5% by weight of the cleaning solution with water.

The method of the present invention provides physically stable aqueous cleaning concentrate compositions that remain homogeneous upon storage, that is, they do not settle, separate or precipitate into different phases. The components of the liquid cleaning concentrate compositions and their relative proportions are selected such that they are compatible with each other resulting in homogeneous liquid formulations. In general, satisfactory stability or compatibility of the polymer additives of the present invention in the cleaning concentrate is indicated if no precipitation or phase separation has occurred at room temperature for at least 1 week, preferably for at least 4 weeks, more preferably for at least 8 weeks and most preferably for at least 6 months when the polymer additive is present at 1%, preferably 2%, by weight in the cleaning concentrate (containing 35 to 40% by weight sodium hydroxide).

Polymer additives useful in the present invention can be made by methods of polymerization well known to those skilled in the art. The polymerizations can be conducted as cofeed, heel, semi-continuous or continuous processes. When the polymerization is conducted as a heel process most, or all, of the one or more unsaturated non-ionizable monomers and any of the unsaturated dicarboxylic acid monomers, if used, are present in the reactor and the one or more unsaturated monocarboxylic acid monomers are fed into the reactor over time. Generally, the feeds are conducted for periods of time from 5 minutes to 5 hours, preferably from 30 minutes to 4 hours, and most preferably from 1 hour to 3 hours.

When the polymerization is run as a cofeed process, initiator and the monomers are introduced into the reaction mixture as separate feed streams that are added linearly over time, i.e., at constant rates. Optional components of the reaction mixture, such as unsaturated dicarboxylic acid monomers, neutralizer solutions, chain regulators and metals, may also be fed into the reaction mixture as separate feed streams or combined with one or more of the other feed streams. Preferably, the optional components are present in the heel. If desired, the streams can be staggered so that one or more of the streams are completed before the others. If desired, a portion of the monocarboxylic acid and non-ionizable monomers and the dicarboxylic acid monomers, if used, and/or a portion of the initiators may be added to the reactor before addition of the monomers is started. The monomers can be fed into the reaction mixture as individual feed streams or combined into one or more feed streams.

The processes by which the polymer additives of the present invention are prepared can be aqueous, solvent or emulsion polymerization; preferably they are prepared by aqueous processes, i.e., substantially free of organic solvents. Water may be introduced into the reaction mixture initially, as a separate feed stream, as the solvent for one or more of the other components of the reaction mixture or some combination thereof Generally, the polymerizations have final solids levels in the range of 20 to 80%, preferably 30 to 70%, by weight of the reaction mixture.

The temperature of the polymerization reaction will depend on the choice of initiator and target molecular weight. Generally, the temperature of the polymerization is up to the boiling point of the system, although the polymerization can be conducted under pressure if higher temperatures are used. Generally, the temperature of the polymerization is from 25° to 120° C. and preferably from 65° to 110° C.

Suitable initiators for preparing polymer additives of the present invention are any conventional water-soluble initiators. Among the suitable initiators that may be used are thermal free-radical initiators, such as hydrogen peroxide, certain alkyl hydroperoxides, dialkyl peroxides, persulfates, peresters, percarbonates, ketone peroxides and azo initiators. Specific free-radical initiators include, for example, hydrogen peroxide, tert-butyl hydroperoxide, di-tert-butyl peroxide, ammonium persulfate, potassium persulfate, sodium persulfate, tert-amyl hydroperoxide and methyl ethyl ketone peroxide. The free-radical initiators are typically used in amounts of 0.5 to 25% based on the total monomer weight. The amount of initiator used will vary according to the desired molecular weight of the resulting polymer and the relative amount of both unsaturated non-ionizable monomers and optional unsaturated dicarboxylic acid monomers. As the relative amount of optional dicarboxylic acid monomer and unsaturated non-ionizable monomer increases, or as the desired molecular weight of the polymer decreases, larger amounts of initiator are preferred.

Water-soluble redox initiators may also be used. Redox initiators include, for example, sodium bisulfite, sodium sulfite, hypophosphites, phosphites, isoascorbic acid, sodium formaldehyde-sulfoxylate and hydroxylamines, used in conjunction with suitable oxidizing agents, such as the thermal free-radical initiators noted above. The redox initiators are typically used in amounts from 0.05 to 10%, preferably from 0.5 to 5%, based on the weight of total monomer. Combinations of initiators can also be used. A preferred method for making the polymers of the present invention uses both a free-radical initiator and a redox initiator. A particularly preferred combination of initiators is persulfate and peroxide.

In one embodiment of the present invention one or more water-soluble metal salts may be used to promote polymerization and to control the molecular weight of the resulting polymers. Water-soluble metal salts, such as the salts of copper, iron, cobalt and manganese, are typically used at levels from 1 to 200 parts per million (ppm), preferably from 3 to 100 ppm, of the metal ion, based on the weight of polymerizable monomers. Preferred metal salts are copper and iron salts, which include all inorganic and organic compounds that will generate copper or iron ions in aqueous solution. Suitable salts include, for example, sulfates, nitrates, chlorides, acetates and gluconates.

It is generally desirable to control the pH of the polymerizing monomer mixture whether using a redox initiator or thermal initiator. The pH of the polymerizing monomer mixture can be controlled by a buffer system or by the addition of a suitable acid or base. The pH of the system can be adjusted to suit the choice of the redox system by the addition of a suitable acid or base, if needed.

In processes where all or some of the monomers are gradually added to the reaction mixture, the pH of the reaction mixture can also be controlled by gradual addition of a neutralizer. Examples of suitable neutralizers include, for example, sodium, potassium or ammonium hydroxide and amines, such as, triethanolamine and ammonia-water. These neutralizers are used as aqueous solutions and can be gradually added into the reaction mixture as a separate feed stream or as part of one of the other feed streams. Typical levels of neutralizers are from 20 to 95 equivalent % of base, preferably from 20 to 80 equivalent % of base, based on the total acid functionality of the monomer components.

Polymerization processes for the preparation of polymer additives used in the present invention generally result in good conversion of the monomers into polymer product. However, if residual monomer levels in the polymer mixture are undesirably high for a particular application, their levels can be reduced by any of several techniques. One common method for reducing the level of residual monomer in a polymer mixture is the post-polymerization addition of one or more initiators or reducing agents to assist scavenging of unreacted monomer.

Preferably, any post-polymerization additions of initiators or reducing agents are conducted at or below the polymerization temperature. The initiators and reducing agents suitable for reducing the residual monomer content are well known to those skilled in the art. Generally, any of the initiators suitable for the polymerization are also suitable for reducing the residual monomer content of the polymer mixture.

The level of initiators or reducing agents added as a means for reducing the residual monomer content should be as low as possible to minimize contamination of the product. Generally, the level of initiator or reducing agent added to reduce the residual monomer content is in the range from 0.1 to 2.0 mole %, preferably from 0.5 to 1.0 mole %, based on the total amount (moles) of polymerizable monomer.

The polymers of the present invention are water-soluble. The water-solubility is affected by the molecular weight of the polymers and the relative amounts, and hydrophilicity, of monomer components incorporated into the polymer. If desired, chain regulators or chain transfer agents may be employed to assist in controlling the molecular weight of the polymers. Any conventional water-soluble chain regulator or chain transfer agent can be used. Suitable chain regulators include, for example, mercaptans, hypophosphites, phosphites, alcohols and bisulfites. If used, mercaptans (such as 2-mercaptoethanol), bisulfites (such as sodium metabisulfite) or hypophosphites are preferred. Some embodiments of the invention are described in detail in the following Examples. All ratios, parts and percentages (%) are expressed by weight unless otherwise specified, and all reagents used are of good commercial quality unless otherwise specified.

EXAMPLE 1

To a 0.5-liter, 4-neck flask equipped with a mechanical stirrer, reflux condenser, thermometer, and inlets for the gradual addition of monomers, caustic solution and initiator solution, was added 75.00 grams of deionized water, 1.60 grams of a 0.15% solution of $CuSO_4$-$5H_2O$ and 35.00 grams of 3-allyloxy-1,2-propanediol. The contents of the flask were heated to 92° C. A monomer solution of 65.00 grams of glacial acrylic acid, a neutralizer solution of 65.00 grams of 50% sodium hydroxide and an initiator solution of 23.50 grams of 30% $H_2O_2$ were added linearly and separately into the flask while stirring over two hours. Once the additions were complete, the system was maintained at 92° C. for an additional thirty minutes, then 0.50 grams of sodium persulfate in 5.00 grams of water was added. The system was then cooled to 60° C.

The resultant polymer solution had a pH of 6.1 and a solids content of 44.1%. Weight average molecular weight ($M_w$) was 8,460 and the number average molecular weight ($M_n$) was 5,570. The residual acrylic acid content was non-detectable (limit of detection=45 ppm).

EXAMPLE 2

To a one-liter, 4-neck flask equipped with a mechanical stirrer, reflux condenser, thermometer, and inlets for the gradual addition of monomers, caustic solution and initiator solution, was added 165.00 grams of deionized water and 60.00 grams of allyl alcohol. The contents of the flask were heated to 89° C. Then, 10% of both a monomer solution containing 140.00 grams of glacial acrylic acid and an initiator solution containing 16.00 grams of sodium persulfate in 50.00 grams of deionized water were added. Following a 2°–3° C. exotherm, the remaining monomer, initiator and 140.00 grams of 50% aqueous sodium hydroxide were added linearly and separately into the flask while stirring over two hours. Once the additions were complete, the system was maintained at 92° C. for an additional thirty minutes. The reaction mixture was then diluted with 70.00 grams of deionized water and residual allyl alcohol was removed by distillation.

The resultant polymer solution had a pH of 6.3 and a solids content of 39.4%. $M_w$ was 8,480 and $M_n$ was 5,050. The residual acrylic acid content was 301 ppm with no detectable residual allyl alcohol.

EXAMPLE 3

To a 0.5-liter, 4-neck flask equipped with a mechanical stirrer, reflux condenser, thermometer, and inlets for the gradual addition of monomers, chain transfer agent and initiator solution, was added 45.00 grams of deionized water, 52.00 grams of maleic acid, 60.90 grams of 50% aqueous sodium hydroxide and 13.00 grams of allyl alcohol. The contents of the flask were heated to 90° C. Then, 50% of a solution containing 5.20 grams sodium hypophosphite in 45.00 grams of deionized water was added. This was followed by the addition, while stirring, of 65.00 grams glacial acrylic acid and the remaining hypophosphite solution as separate feed streams over 120 minutes and 105 minutes, respectively. Once the additions were complete, the system was maintained at 92°–94° C. for 30 minutes. The solution polymer was diluted with 51 grams of deionized water and 52.3 grams of 50% sodium hydroxide and concentrated to 48.7% solids by distillation.

The resultant polymer solution had a pH of 6.5. $M_w$ was 3,870 and $M_n$ was 3,280. The residual acrylic acid content was 781 ppm and the residual maleic acid content was 1161 ppm.

EXAMPLE 4

To a 0.5-liter, 4-neck flask equipped with a mechanical stirrer, reflux condenser, thermometer, and inlets for the gradual addition of monomers, chain transfer agent and initiator solution, was added 58.00 grams of deionized water, 32.50 grams of maleic acid, 19.50 grams of 3-allyloxy-1,2-propanediol, 3.00 grams of 0.15% $FeSO_4.7H_2O$ and 16.80 grams of 50% aqueous sodium hydroxide. The contents of the flask were heated to 85° C. and the following feed streams were then added linearly and separately into the flask while stirring over two hours: 78.00 grams of glacial acrylic acid, a solution of 3.25 grams of sodium persulfate in 20.00 grams of deionized water, and a solution of 13.00 grams of sodium metabisulfite dissolved in 35.00 grams of deionized water. Once the additions were complete, the system was maintained at 85° C. for 30 minutes, then cooled to 77° C. This was followed by the addition of 0.12 grams of sodium persulfate in 5.00 grams of deionized water. After stirring for 5 minutes, another solution of 0.12 grams of sodium persulfate in 5.00 grams of deionized water was added. The solution was then diluted with 40.00 grams of deionized water and the pH was adjusted by the gradual addition of 98.80 grams of 50% aqueous sodium hydroxide.

The resultant polymer solution had a pH of 6.5 and a solids content of 43.0%. $M_w$ was 8,350 and $M_n$ was 5,140. The residual acrylic acid content was 1900 ppm and the residual maleic acid content was 4100 ppm.

EXAMPLES 5–54

Alkali-Solubility and Storage-Stability of Cleaning Concentrates

Polymer additives of the present invention were tested for alkali-solubility and storage-stability by the following method: to a 118-milliliter (4-ounce) glass jar was added 2.0 grams of polymer solid followed by the addition of water such that the total weight was 20.00 grams. Then, to this solution in an ice-water bath 80.00 grams of 50% sodium hydroxide was added with stirring such that the temperature did not exceed 25° C. The solution was allowed to stand before observations were made.

Satisfactory alkali-solubility or storage-stability of the polymer additives of the present invention was indicated if no precipitation or phase separation has occurred at room temperature for at least 1 week (see Table 2). Solubility data in the Table are based on polymer additives tested at 2% by weight in 80% caustic (50% sodium hydroxide). Certain polymer additives were also tested at 1% by weight in 80% caustic for extended periods of time; these data are indicated as superscripts in the Alkali Solubility column designating the minimum number of weeks ($^4$ or $^8$) that they were soluble at the 1% level. Abbreviations used in the Table are listed below with the corresponding descriptions; polymer additive compositions are designated by the relative proportions of acrylic acid, maleic acid and unsaturated non-ionizable monomer (X). Examples 5, 6 and 14 represent comparative (comp) polymer additive compositions containing no unsaturated non-ionizable monomer. Polymer additives containing 50 to 70% AA, 11 to 31% MALAC and 11 to 31% HEA were also evaluated for solubility in high caustic concentrates and were found to be insoluble under the conditions described above.

AA=Acrylic Acid

MALAC=Maleic Acid

AOP=3-Allyloxy-1,2-Propanediol

ALC=Allyl Alcohol

AOE=Allyloxyethanol

HEA Hydroxyethyl Acrylate

NA=Not Analyzed

+=Soluble in caustic

−=Insoluble in caustic

TABLE 2

| Ex # | Polymer Additive Composition (AA/MALAC/X) | $M_w$ | Alkali Solubility | Anti-Spotting Efficiency |
|---|---|---|---|---|
| 5 | 100/0/0 (comp) | 4,500 | − | 2.5 |
| 6 | 100/0/0 (comp) | 2,000 | − | 3.5 |
| 7 | 90/0/10 AOP | 3,640 | − | NA |
| 8 | 85/0/15 AOP | 3,730 | − | NA |
| 9 | 75/0/25 ALC | 8,920 | + | NA |
| 10 | 75/0/25 AOE | 12,100 | − | NA |
| 11 | 70/0/30 ALC | 8,480 | + | 5 |
| 12 | 70/0/30 AOP | 8,570 | − | NA |
| 13 | 70/20/10 ALC | 4,250 | $+^4$ | 0.5 |
| 14 | 70/30/0 (comp) | 30,000 | − | NA |
| 15 | 65/0/35 AOE | 6,770 | − | NA |
| 16 | 65/0/35 AOP | 10,300 | − | NA |
| 17 | 65/0/35 AOP | 8,460 | + | NA |
| 18 | 65/15/20 ALC | 4,670 | + | 0.5 |
| 19 | 65/15/20 AOP | 4,440 | + | 0.5 |
| 20 | 65/20/15 ALC | 4,830 | + | 0 |
| 21 | 62/0/38 AOP | 32,000 | − | NA |
| 22 | 62/0/38 ALC | 5,910 | + | NA |
| 23 | 62/0/38 AOE | 7,410 | − | NA |
| 24 | 60/10/30 AOP | 7,340 | + | NA |
| 25 | 60/15/25 AOP | 9,530 | + | 0 |
| 26 | 60/15/25 AOP | 4,680 | + | 0 |
| 27 | 60/15/25 ALC | 6,620 | + | 1 |
| 28 | 60/15/25 AOE | 6,580 | + | NA |
| 29 | 60/20/20 AOP | 4,220 | + | 0 |
| 30 | 60/25/15 ALO | 3,390 | $+^4$ | 0 |

TABLE 2-continued

| Ex # | Polymer Additive Composition (AA/MALAC/X) | $M_w$ | Alkali Solubility | Anti-Spotting Efficiency |
|---|---|---|---|---|
| 31 | 60/25/15 ALC | 4,880 | + | 0 |
| 32 | 60/25/15 AOP | 8,350 | $+^8$ | 0.5 |
| 33 | 55/25/20 AOP | 4,960 | $+^4$ | 0 |
| 34 | 55/25/20 AOP | 3,680 | $+^4$ | 0.5 |
| 35 | 55/30/15 AOP | 3,570 | + | NA |
| 36 | 55/30/15 AOP | 8,260 | + | 0.5 |
| 37 | 55/30/15 AOP | 11,800 | $+^8$ | 0.5 |
| 38 | 55/35/10 AOP | 3,950 | − | NA |
| 39 | 53/35/12 AOP | 4,570 | + | NA |
| 40 | 50/40/10 ALC | 3,870 | $+^4$ | 0 |
| 41 | 50/40/10 AOP | 4,320 | − | NA |
| 42 | 50/38/12 AOP | 4,380 | + | NA |
| 43 | 50/38/12 AOP | 5,950 | + | NA |
| 44 | 50/35/15 AOP | 3,010 | $+^4$ | 0.5 |
| 45 | 50/35/15 AOP | 4,430 | $+^4$ | 0.5 |
| 46 | 50/35/15 AOP | 6,740 | + | 0 |
| 47 | 50/35/15 AOP | 8,870 | $+^8$ | 0.5 |
| 48 | 50/35/15 AOP | 11,600 | $+^8$ | 0.5 |
| 49 | 50/35/15 ALC | 3,200 | $+^4$ | 0.5 |
| 50 | 50/30/20 AOE | 4,650 | − | NA |
| 51 | 50/30/20 AOP | 4,850 | $+^4$ | 0 |
| 52 | 43/38/19 AOP | 5,510 | + | NA |
| 53 | 40/40/20 AOP | 4,790 | + | NA |
| 54 | 35/50/15 AOP | 4,070 | $+^8$ | 0.5 |

EXAMPLE 55

Scale Inhibition—Test Method

Polymer additives of the present invention were evaluated for scale-inhibition (anti-spotting efficiency) under conditions simulating temperature and caustic concentrations (0.5% sodium hydroxide at 60° C.) typically encountered in bottle-washing and CIP operations by determining the amount of carbonate scale formed on microscope slides after overnight storage at 60° C.

Aqueous test solutions were prepared containing the required amount of caustic (sodium hydroxide) and 200 ppm (0.02% by weight) polymer additive; water hardness was equivalent to 400 ppm (as $CaCO_3$). The microscope slides were placed in beakers containing the test solutions and the beakers and their contents were maintained at 60° C. overnight (approximately 14 to 18 hours). The microscope slides were then removed from the beakers and evaluated for cleanliness: "0" represented "no carbonate scale" (clean slide) and "5" represented "heavy carbonate scaling" (slide totally covered by white layer of carbonate). The anti-spotting values are summarized in Table 2. Anti-spotting values of 0.5 were typical for conventional phosphonate scale-inhibitors used alone (without polymer additives) at 100 ppm in the presence of 0.5% sodium hydroxide. Generally, satisfactory scale-inhibition is indicated by anti-spotting values of less than or equal to 2–3, preferably less than or equal to 1 and more preferably less than or equal to 0.5.

I claim:

1. A method for preparing a stable aqueous cleaning concentrate comprising combining in an aqueous solution:

(a) from 1 to 10 percent, based on total cleaning concentrate weight, of a water-soluble polymer comprising as polymerized units:

(i) from 20 to 80 percent, based on total polymer weight, of unsaturated monocarboxylic acid monomer selected from one or more of acrylic acid, methacrylic acid and water-soluble salts thereof;

(ii) from 0 to 65 percent, based on total polymer weight, of unsaturated dicarboxylic acid monomer; and (iii) from 10 to 30 percent, based on total polymer weight, of unsaturated non-ionizable monomer selected from one or more monomers of Formula I:

$$CH_2{=}C(R^1)CH(R^2)OR^3 \quad (I)$$

where:

$R^1$ is selected from hydrogen, methyl and —$CH_2OH$;

$R^2$ is selected from hydrogen, methyl and —$CH_2OH$;

$R^3$ is selected from hydrogen, —$CH_2CH(CH_3)OH$, —$CH_2CH_2OH$ and ($C_3$–$C_{12}$)-containing polyol residues; and (b) from 15 to 50 percent, based on total cleaning concentrate weight, of an alkali metal hydroxide selected from one or more of sodium hydroxide and potassium hydroxide.

2. The method of claim 1 wherein the water-soluble polymer comprises as polymerized units from 40 to 55 percent of the unsaturated monocarboxylic acid monomer, from 30 to 50 percent of the unsaturated dicarboxylic acid monomer and from 10 to 20 percent weight of the unsaturated non-ionizable monomer.

3. The method of claim 1 wherein the water-soluble polymer comprises as polymerized units from 60 to 80 percent of the unsaturated monocarboxylic acid monomer, from 0 to 10 percent of the unsaturated dicarboxylic acid monomer and from 20 to 40 percent weight of the unsaturated non-ionizable monomer.

4. The method of claim 1 wherein the unsaturated non-ionizable monomer is selected from one or more of allyl alcohol and 3-allyloxy-1,2-propanediol.

5. The method of claim 1 comprising combining from 25 to 40 percent, based on total cleaning concentrate weight, of the alkali metal hydroxide in the aqueous solution.

6. The method of claim 1 comprising combining from 1 to 2 percent, based on total cleaning concentrate weight, of the water-soluble polymer in the aqueous solution.

7. The method of claim 1 further comprising combining from 1 to 20 percent, based on total cleaning concentrate weight, of conventional cleaning additives selected from one or more of builders, sequestrants, water-soluble surfactants, anti-foaming agents, corrosion inhibitors, bleaching agents, stabilizers, anti-spotting agents and opacifiers.

8. An aqueous cleaning concentrate comprising:

(a) from 1 to 10 percent, based on total cleaning concentrate weight, of a water-soluble polymer comprising as polymerized units:

(i) from 20 to 80 percent, based on total polymer weight, of unsaturated monocarboxylic acid monomer selected from one or more of acrylic acid, methacrylic acid and water-soluble salts thereof;

(ii) from 0 to 65 percent, based on total polymer weight, of unsaturated dicarboxylic acid monomer; and (iii) from 10 to 30 percent, based on total polymer weight, of unsaturated non-ionizable monomer selected from one or more monomers of Formula I:

$$CH_2{=}C(R^1)CH(R^2)OR^3 \quad (I)$$

where:

$R^1$ is selected from hydrogen and methyl and —$CH_2OH$;

$R^2$ is selected from hydrogen, methyl and —$CH_2OH$;

$R^3$ is selected from hydrogen, —$CH_2CH(CH_3)OH$, —$CH_2CH_2OH$ and ($C_3$–$C_{12}$)-containing polyol residues;

(b) from 15 to 50 percent, based on total cleaning concentrate weight, of an alkali metal hydroxide selected from one or more of sodium hydroxide and potassium hydroxide; and (c) water.

9. The cleaning concentrate of claim 8 wherein the polymer has a weight-average molecular weight from 4,000 to 10,000.

10. The cleaning concentrate of claim 8 further comprising from 1 to 20 percent, based on total cleaning concentrate weight, of conventional cleaning additives selected from one or more of builders, sequestrants, water-soluble surfactants, anti-foaming agents, corrosion inhibitors, bleaching agents, stabilizers, anti-spotting agents and opacifiers.

11. A cleaning solution formed by diluting the cleaning concentrate of claim 8 to 0.1 to 5 percent by weight of the cleaning solution with water.

12. A method for cleaning hard surface materials comprising contacting a soiled hard surface material with an effective amount of the cleaning solution of claim 11.

13. A cleaning solution comprising:

(a) 0.005 to 0.4 percent, based on total cleaning solution weight, of a water-soluble polymer comprising as polymerized units:

(i) from 20 to 80 percent, based on total polymer weight, of unsaturated monocarboxylic acid monomer selected from one or more of acrylic acid, methacrylic acid and water-soluble salts thereof;

(ii) from 0 to 65 percent, based on total polymer weight, of unsaturated dicarboxylic acid monomer; and (iii) from 10 to 30 percent, based on total polymer weight, of unsaturated non-ionizable monomer selected from one or more monomers of Formula I:

$$CH_2{=}C(R^1)CH(R^2)OR^3 \quad (I)$$

where:

$R^1$ is selected from hydrogen and methyl and —$CH_2OH$;

$R^2$ is selected from hydrogen, methyl and —$CH_2OH$;

$R^3$ is selected from hydrogen, —$CH_2CH(CH_3)OH$, —$CH_2CH_2OH$ and ($C_3$–$C_{12}$)-containing polyol residues;

(b) 0.1 to 3 percent, based on total cleaning solution weight, of an alkali metal hydroxide selected from one or more of sodium hydroxide and potassium hydroxide; and (c) water.

14. The cleaning solution of claim 13 further comprising from 0.001 to 2 percent, based on total cleaning solution weight, of conventional cleaning additives selected from one or more of builders, sequestrants, water-soluble surfactants, anti-foaming agents, corrosion inhibitors, bleaching agents, stabilizers, anti-spotting agents and opacifiers.

15. A method for preparing the cleaning solution of claim 13 comprising combining, as separate components, the water-soluble polymer, a 20 to 50 percent aqueous solution of the alkali metal hydroxide, and water; wherein the polymer, the alkali metal hydroxide solution and the water are added as separate streams into an in-line mixing system.

16. A method for cleaning hard surface materials comprising contacting a soiled hard surface material with an effective amount of the cleaning solution of claim 13.

17. The method of claim 1 further comprising combining from zero to 2 percent, based on total cleaning concentrate weight, of low-foaming water-soluble surfactant selected from one or more anionic, non-ionic, zwitterionic and amphoteric surfactants.

18. The aqueous cleaning concentrate of claim 8 further comprising from zero to 2 percent, based on total cleaning concentrate weight, of low-foaming water-soluble surfactant selected from one or more anionic, non-ionic, zwitterionic and amphoteric surfactants.

* * * * *